United States Patent [19]

Melanson

[11] Patent Number: 4,855,575

[45] Date of Patent: Aug. 8, 1989

[54] ELECTROCERAMIC HEATING DEVICES

[75] Inventor: Lionel J. Melanson, Casco, Me.

[73] Assignee: GTE Products Corporation, Stamford, Conn.

[21] Appl. No.: 252,410

[22] Filed: Oct. 3, 1988

[51] Int. Cl.[4] ..... H05B 3/03

[52] U.S. Cl. ..... 219/541; 219/505; 219/543; 219/548; 29/874; 29/885; 264/61

[58] Field of Search ..... 219/504, 505, 541, 543, 219/548; 338/307, 309, 312, 327, 329, 22; 264/61; 156/89; 29/857, 885, 874, 875, 877, 858, DIG. 39, DIG. 38, 854, 610.1

[56] References Cited

U.S. PATENT DOCUMENTS

| | | | |
|---|---|---|---|
| 3,277,232 | 10/1966 | Ragan | 338/312 |
| 4,164,067 | 8/1979 | Brandt | 338/309 |
| 4,758,814 | 7/1988 | Howng | 338/329 |

*Primary Examiner*—A. D. Pellinen

*Assistant Examiner*—Leon K. Fuller

*Attorney, Agent, or Firm*—James Theodosopoulos

[57] ABSTRACT

An electroceramic device formed of a body of electroceramic material and a process of making the device is disclosed. The body has an outer perimeter edge and two sides, each of the sides forming an exterior face. At least one groove is disposed on one of the exterior faces of the body, the groove extending from the edge and forming an opening on the exterior face. A lead wire is disposed in the groove and extends outwardly from the body through the edge. A metallized, electrically conductive coating is disposed on each of the exterior faces, and are electrically insulated from each other. The coating fills any voids left between the lead wire and the interior of the groove, whereby to hold the lead wires in place within the groove and form an electrical connection with the coating. Another lead wire is provided for the other coating, and that lead wire may be disposed in another similar groove.

11 Claims, 1 Drawing Sheet

ELECTROCERAMIC HEATING DEVICES

The present invention relates to electroceramic devices and particularly to such devices having radially extending lead wires, the inner ends of which have been disposed in grooves in the body of the device and secured thereto by metallized coatings which form the electrodes. Such devices are commonly called PTC thermistors.

BACKGROUND OF THE INVENTION

Electroceramic devices that exhibit positive thermal coefficients are generally made from doped barium titanate ceramics which have sharp positive temperature coefficients of resistance. Such ceramics are designed so that below a critical temperature, the resistance of the ceramic remains at a low value and is essentially constant. When a particular temperature is reached, a crystalline phase change takes place in the ceramic and this change in the crystal structure is accompanied by a sharp increase in the resistance at the crystalline grain boundaries. The result of this crystalline change is an increase in the device's resistance of several orders of magnitude over a small temperature range. For example, barium titanate heaters with a room temperature resistance of 3.0 ohms can increase to 1,000 ohms or more during a crystalline phase change. The temperature at which crystalline phase change takes place can be adjusted in the manufacturing process through the use of appropriate chemical additives and can attain temperatures as high as 300° C., and even higher.

Commonly, current is carried to the devices by means of lead wires that are attached to metallized coatings which form the electrodes for the electroceramic body. Many ways have been provided for attaching the leads in the past, and this invention especially relates to an improvement in attaching the lead wires to the body.

DISCUSSION OF THE PRIOR ART

In general the prior art has attached leads to electroceramic bodies by means of a conductive epoxy, soldering or welding.

The use of conductive epoxy has limited application at high temperatures, the maximum continuous use temperature of most epoxy materials being about 180° C. While the conductive epoxy has good mechanical strength at room temperatures, the joint strength declines at operating temperatures of the devices of the present invention. Electrical conductance of most conductive epoxies is also several orders of magnitudes lower than other attachment means because of the inherent insulating properties of the resins. Moreover, epoxy materials which are conductive are rather expensive and the process of applying them is fairly cumbersome.

Soldered leads are frequently used also. Such soldered leads, however, are susceptible to thermal shock during conventional soldering steps, that is dipping the ceramic into molten solder. Pre-heating and annealing steps must be provided to successfully accomplish the soldering. Moreover, the temperature range in which the flux does not become charred is also quite small, and when soldering a large electroceramic device, one greater than 8 grams, for example, pre-heat times in excess of 1 minute are frequently required.

Annealing times also become extremely critical to avoid thermal shock. Furthermore, conventional solders frequently have limited applicability because their low liquidus temperature.

High temperature solder alloys have been also used to attach lead wires to ceramic bodies that form the devices. Such high temperature solders require active fluxes, however. Frequently, the resistance of the electroceramic device is degraded during this type of soldering operation because of the presence of a very active solder flux, and when the device is heated, the resistance is reduced, depending upon the duration of the heating. Such reductions appear to be produced because of the reduction of grain boundaries by the flux, that is by the absorption of oxygen, which contributes to the resistance. Large PTC thermistors are particularly susceptible to such degradation because a long pre-heat time is required while the flux is present. Also, the heating causes the flux to char and requires the devices to be cleaned to remove the residue.

Welding the leads to the device is also commonly used, but this process too also has significant drawbacks. To weld, metallization of the body must be done to provide for precise coating thicknesses. Moreover, welding requires coatings of two different electrode materials. The first material forms an ohmic contact with the electroceramic device and this layer is not resistance weldable. Thus, a second material must be coated over the ohmic layer to facilitate resistance welding. The choice of wire materials, furthermore, is severely limited by resistance welding. Other welding methods such as ultrasonic welding require fairly costly equipment when the methods are used in production.

SUMMARY OF THE INVENTION

According to the present invention, I have discovered a new electroceramic thermistor device in which the electrodes and the radial leads are attached to the ceramic in a single process step. According to my invention, I have discovered that by forming grooves in the surface of a green, unsintered body of electroceramic material that the lead wires can be disposed in these grooves and subsequently firmly and conductively attached to the device with metallizing coatings that are used to form the electrodes. Preferably, the inner ends of the lead wires are swaged in those portions which are disposed in the grooves, the swaging being such that the inner ends have a long diameter which is at least about 25% wider than the diameter of the outer ends. The wires are disposed in the grooves after the ceramic has been sintered. A groove can be made in the ceramic by machining it into the pressed green material or by using a die that has a raised portion formed thereon, thus producing grooved parts of the appropriate shape. The size and shape of the groove is determined by the size and shape of the lead wire to be disposed therein, taking into consideration conventional calculations required because the sintering operation shrinks the material that is being made.

Useable lead wire material is only limited by its compatibility to the metallizing material. Lead wire materials can be, for example, copper, copper clad steel, tin plated copper clad steel and aluminum.

After the lead wires are disposed in the grooves, the ceramic is sprayed using conventional thermal metallizing techniques for coating ceramic surfaces. The metallizing material is sprayed onto and around the wires creating ohmic electrodes which simultaneously provides an electrical connection and secures the lead wires by coating over and around them so as to cover them and embed them in the coating. Metallizing materials that have applicability with the present invention include tin, zinc, copper and iron. Aluminum, however, has proven to be the best electrode material for use with most ceramics. Aluminum is compatible with all lead wire materials, I have found and makes a good ohmic contact with the ceramic and has excellent adhesion.

In accordance with the present invention, I have found that no damage or production failures occur due to thermal shock. The device according to the present invention has excellent electrical characteristics and is not degraded due to the use of fluxes. Fluxes, solder and cleaning solvents can be eliminated to produce a finished device of increased aesthetic value. The switch temperature of the devices can be very high since solder is not being used.

DESCRIPTION OF THE PREFERRED EMBODIMENT

Figure 1:
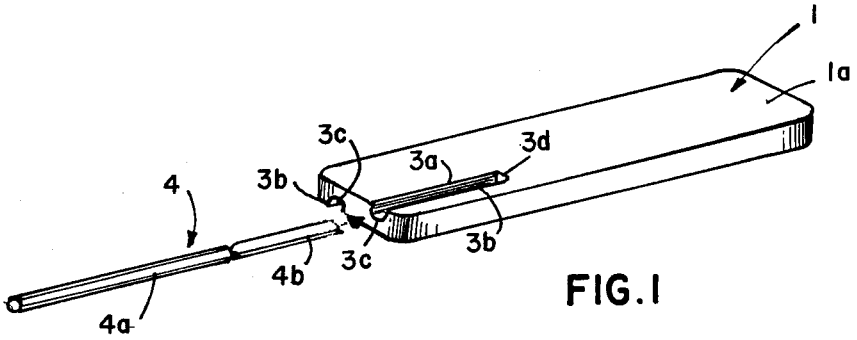
FIG. 1 is a perspective view of a green, unsintered electroceramic device before the lead wires are disposed thereon.

Referring now to FIG. 1, a green, unsintered barium titanate body is shown which will form the electroceramic device. The body 1 is made in a flat shape and is formed, generally, of doped barium titanate ceramics which have a positive temperature coefficient of resistance. The device is designed such that below a critical temperature, the resistance of the ceramic remains at a low value and is essentially constant. When the ceramic's anomaly temperature is reached, a crystalline phase change takes place in the ceramic and this change in crystal structure is accompanied by a sharp increase in resistance at the crystalline grain boundaries. The result of this crystalline change is an increase in the heater resistance of several orders of magnitude over a very small shift in temperature. The temperature at which the crystalline phase change takes place can be adjusted prior to forming the green ceramic body through the use of appropriate and well known chemical dopants and can be varied between 50° and 300° C., and even higher. When energized with a suitable voltage by applying current to electrodes on opposite sides of the device, the ceramic rapidly heats up to its predetermined operating or anomaly temperature and then "locks it" at this temperature.

This rapid heating is due to the initial low resistance of the ceramic which results in an internal high power of the heater. The "lock in" is due to the abrupt increase in resistance which causes generated power to be reduced until it equals dissipated power. At that point, thermal equilibrium is achieved and the body 1 self-regulates itself at the temperature.

The unsintered body 1 is formed of two external surfaces 1*a* (of which only one is shown). A preferably semi-circular groove 3 is formed on opposite sides of each of the external surfaces 1*a*. The grooves 3 may be machined into the green unsintered body 1, or preferably may be cast therein during the manufacturing process. The grooves 3 are each formed of a pair of sidewalls 3*a* and 3*b* and a bottom wall 3*c*. The length of the groove 3 is determined by the end wall 3*d*. The height of the sidewalls 3*a* and the bottom wall 3*c* can be varied, as desired, however caution must be taken to avoid weakening the body 1 by making it too deep.

A lead wire 4 is divided into two sections for 4*a* and 4*b* for purposes of explaining the present invention. At the inner end 4*b*, the lead wire is swaged so as to flatten it into a generally oval cross-sectional shape and distort the wire such that its long diameter is at least between about 25 and 50% wider than the diameter of the outer end 4*a*.

The width of the groove 3, that is the distance between the sidewalls 3*a* and 3*b*, is such to snugly receive the swaged end 4*b* and allow it to engage the bottom wall 3*c*. Since the ceramic body 1 is green in the view sown in FIG. 1, adequate compensation must be made in calculating these dimensions according to the well known shrinkage characteristics of sintering operations. Adjustment of the depth and width of the groove can easily be made to allow for snug disposition of the swaged end 4*b* of lead wire 4 in the groove 3 of the sintered product.

Figure 2:
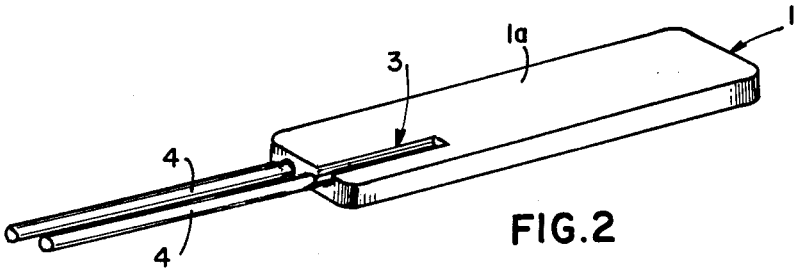
FIG. 2 is a perspective view of the electroceramic device shown in FIG. 1 (after sintering) in which the lead wires have been disposed in grooves formed on opposite sides of the electroceramic device.

Referring now to FIG. 2, the ceramic body 1 has been sintered according to conventional techniques. Lead wires 4 are shown with the swaged ends 4*b* disposed within groove 3. The ceramic body 1 with the lead wires 4 is then ready for the metallizing process to produce the finished device illustrated in FIG. 3.

Figure 3:
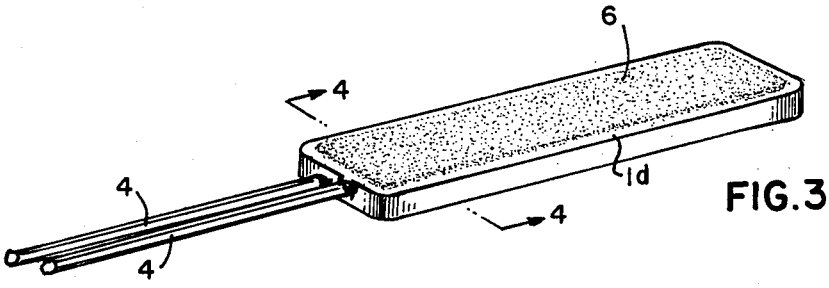
FIG. 3 is a perspective view of the device showing the lead wires embedded beneath a metallized electrode that has been coated on the surfaces of the electroceramic device to form the finished product.

In FIG. 3, the electroceramic device has been made by spraying the fired body 1 with a thermally metallized coating 6 of copper, nickel or preferably aluminum. The edges have been masked during the spraying operation to form a shoulder 1*d* which will prevent the metallized coating 6 on one side of the body 1 from touching the coating on the other side. While the coatings 6 are texturized as a result of the metallizing process, that is they have a rough external appearance, the average thickness is generally between about 8 and 20 mils with a density of approximately 2.4 grams per cc. While the coating thickness is not necessarily critical, sufficient coating 6 should be disposed on the body 1 to provide a good electrode and to fill any voids in the groove 3 which remain between the sidewalls 3*a* and 3*b* that are formed on the exterior surfaces 1*a* and 1*b*. When the metallizing is completely, the lead wires 4 are firmly affixed within the grooves 3 by the metallizing material.

Figure 4:
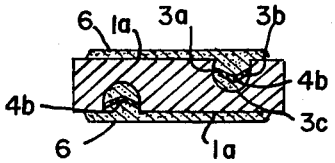
FIG. 4 is a cross sectional view of the device taken along the line 4—4 of FIG. 3.

Referring to FIG. 4, the disposition of the two coatings 6 is shown on the external surfaces 1*a*. Lead wires 4*a* are disposed in the grooves 3. The sides of the lead wire preferably rest against the side walls and bottom walls of the groove 3. As shown, the metallized coatings 6 cover the external surfaces of the body 1 (except the shoulder 1*d*) and fill in around the groove 3 to anchor the lead wires 4 in place and provide for electrical connections.

To form the device, the disposition of the metallized coating 6 and the lead wire attachment is achieved in a single processing step. I have discovered that by forming the grooves into the surface of the pre-fired, green, unsintered ceramic in a size and shape that will accept them after sintering, that I can place the lead wire into the fired, grooved ceramic and then spray (by the well known thermal metallizing techniques one side at a time) aluminum or other metallizing surfaces onto the ceramic surfaces. On each side of the body, the metallizing coating is sprayed onto and around the wire, creating an electrode and simultaneously making an electrical connection and also attaching the lead wire by coating over and around it so as to cover and embed the wire into the coating.

As previously stated, the groove 3 in the unfired ceramic body 1 can be made by machining it into the pressed green material or can be provided by using a pressing die with the grooved form made into the die shape, thus producing the green parts in the same way as any other green ceramic part. The size and shape of the groove 3 is determined by the size and shape of the lead wire 4 to be inserted and the well known sintering shrink factors are applied to the shape. The metal coating is applied according to well known techniques of applying molten metal to substrates. In spraying the body 1 with the metallizing material, a modification of a fixture which holds the fired ceramic and masks the edges to form the insulating shoulder is necessary to allow for insertion of the lead wires. The thickness of the spray coating needed to embed the wires depends upon the size of the wire, its shape and the degree of mechanical strength needed for the application. In the preferred embodiment, the location of the grooves 3 should be offset from one another so as not to decrease the voltage capability in the finished device and to provide it with adequate structural integrity to allow it to be used.

It is apparent that modifications and changes may be made within the spirit and scope of the present invention but it is my intention, however, only to be limited by the scope of the appended claims.

As my invention, I claim:

1. An electroceramic device comprising:

a body of electroceramic material, said body having an outer perimeter edge and two sides, each of the sides forming an exterior face of said body;

at least one groove disposed on one of the exterior faces of said body, said groove extending from said edge and forming an opening on said exterior face;

a lead wire disposed in said groove and extending outwardly from said body through said edge; and a metallized electrically conductive coating disposed on each of said exterior faces forming electrodes, said coatings being electrically insulated from each other, one of said coatings filling voids left between said lead wire and the interior of said groove, whereby to hold said lead wires in place within said groove and form an electrical connection with said coating; and means to conduct current to the other of said coatings.

2. The electroceramic device according to claim 1 wherein said body is capable of producing heat upon application of current to said electrodes.

3. The electroceramic device according to claim 1 wherein the electrodes are formed of sprayed metallic coatings, said coatings having a rough external surface thereon.

4. The electroceramic device according to claim 1 wherein the average thickness of the electrodes is between 8 and 20 mils.

5. The electroceramic device according to claim 1 wherein the lead wires are swaged in at the end disposed within the groove whereby to substantially engage the edges of said groove.

6. The electroceramic device according to claim 1 wherein the metallic electrodes are disposed inside of the perimeter of said body, whereby to form uncoating shoulders around the outer edges of said body and to provide electrical insulation of the electrodes from each other.

7. The electroceramic device according to claim 1 wherein the swaged section of the lead wire is at least 25% greater than the diameter of the wire.

8. The electroceramic device according to claim 1 wherein there are two grooves on said device, each of said grooves being on opposite sides of said body and being laterally offset from each other; and a lead wire disposed in each of said grooves.

9. A process for manufacturing an electroceramic device, the steps which comprise:

forming a body of green, unsintered ceramic material having electrical properties;

forming at least one groove on an external surface of said body;

sintering said ceramic material;

disposing a lead wire in said groove, the disposition being such that at least a portion of said lead wire extends outwardly from said body; and disposing a metallic coating over said external surface and over said groove and over said lead wire, whereby simultaneously to provide an electrode and secure said lead wire to said body and form an electroceramic device.

10. The method for manufacturing an electroceramic device according to claim 9 wherein two grooves are formed on said body, each of said grooves being on external surfaces on opposite sides of said body, said grooves being laterally offset from each other;

disposing a lead wire in each of said grooves; and disposing a metallic coating over each of the external surfaces.

11. The method for manufacturing the electroceramic device according to claim 9 wherein the electrodes are formed by spraying molten metal, said coatings having a rough external surface thereon.

* * * * *